US010406673B2

(12) United States Patent
Shechtman et al.

(10) Patent No.: US 10,406,673 B2
(45) Date of Patent: Sep. 10, 2019

(54) ORGANIZER WITH LOCKING MECHANISM

(71) Applicant: The Stanley Works Israel Ltd., Rosh Ha'Ayin (IL)

(72) Inventors: Victoria Shechtman, Holon (IL); Gal Avigad, Gonen (IL); Gilad Moisa, Hod HaSharon (IL)

(73) Assignee: The Stanley Works Israel Ltd., Rosh Ha'Ayin (IL)

( * ) Notice: Subject to any disclaimer, the term of this patent is extended or adjusted under 35 U.S.C. 154(b) by 0 days.

(21) Appl. No.: 16/189,052

(22) Filed: Nov. 13, 2018

(65) Prior Publication Data

US 2019/0152043 A1 May 23, 2019

Related U.S. Application Data

(60) Provisional application No. 62/587,553, filed on Nov. 17, 2017.

(51) Int. Cl.
*B25H 3/02* (2006.01)
*E05B 65/462* (2017.01)

(52) U.S. Cl.
CPC ..... *B25H 3/022* (2013.01); *E05B 65/462* (2013.01); *E05Y 2900/602* (2013.01)

(58) Field of Classification Search
USPC ..... 206/372, 373, 1.5
See application file for complete search history.

(56) References Cited

U.S. PATENT DOCUMENTS 5,069,342 A 12/1991 Dickinson
6,626,295 B1 * 9/2003 Vasudeva ..... B25H 3/023 206/373
7,513,364 B2 * 4/2009 Tsai ..... A45C 13/28 206/1.5
2002/0027403 A1 3/2002 Vasudeva
2003/0168952 A1 * 9/2003 Huang ..... B25H 3/023 312/325
2004/0012314 A1 1/2004 Hay et al.
2005/0241973 A1 11/2005 Adkins
2007/0062831 A1 * 3/2007 Chen ..... A45C 13/1084 206/373
2009/0223971 A1 * 9/2009 Moffett ..... B25H 3/023 220/500
2011/0233089 A1 * 9/2011 Verk ..... B25H 3/003 206/379

FOREIGN PATENT DOCUMENTS

EP 2308655 A2 4/2011

OTHER PUBLICATIONS

EP ESSR dated, May 24, 2019 cited in co-pending application 18206799.1-1019.

* cited by examiner

*Primary Examiner* — Jacob K Ackun
(74) *Attorney, Agent, or Firm* — Bruce S. Shapiro

(57) ABSTRACT

An organizer containing a housing with a plurality of compartments, at least one bin disposed in a compartment and pivotally attached thereto. The organizer further includes a locking mechanism that selectively locks the bin in place when the bin is in its fully closed position. When more than one bins are present, the locking mechanism is also capable of locking a first bin in its fully closed position while simultaneously allowing a second bin to move from its open position to being locked in its fully closed position, without unlocking the first bin.

16 Claims, 8 Drawing Sheets

ORGANIZER WITH LOCKING MECHANISM

CROSS-REFERENCE TO RELATED APPLICATIONS

This application claims priority to U.S. Provisional Patent Application Ser. No. 62/587,553 filed Nov. 17, 2017, which is hereby incorporated herein by reference in its entirety.

FIELD OF THE INVENTION

This application relates to an organizer, and more specifically to a flip bin organizer having a plurality of bins that are pivotally engaged to the organizer. The flip bin organizer further includes a locking mechanism that is configured to selectively lock the bins in their fully closed position.

BACKGROUND OF THE INVENTION

Organizers are well known. They are commonly used to separate and transport a variety of small accessories, such as screws, nuts, bolts, washers, etc. Organizers typically have a housing and a plurality of bins. Each bin is typically dedicated to a single item and tradespersons are constantly moving between the bins to find and use the appropriate accessory.

The ways in which tradespersons work with organizers are as diverse as the tradespersons themselves. For example, some tradespersons move often from bin to bin. They are constantly opening and closing bins as is necessary. For this, unfettered access to each bin is required. Conversely, other persons may wish to work with only one or two bins at a time. These bins may remain open while all of the others are locked in their closed position. Still others like to work by removing bins from the organizer housing entirely.

There is a need in the art for an improved organizer that is capable of selectively locking and unlocking of bins and simultaneously accommodating all of the ways in which tradespersons use an organizer. The present invention addresses one or more of the above referenced issues.

SUMMARY OF THE INVENTION

The present invention relates to an organizer including a housing having one or more compartments for receiving a bin. The organizer also includes a first bin disposed in a compartment and comprising a front panel, a back panel, a right side panel, a left side panel, and a bottom panel all of which define an interior portion, wherein said first bin is pivotally attached within the compartment, and is configured to reciprocally move between an open position, a first closed position and a fully closed position, wherein the first closed position is between the open position and the fully closed position, and wherein in the open position, access to the interior portion is unimpeded, and in the first closed position, access to the interior portion is impeded, but the bin is not lockable, and in the fully closed position access to the interior portion is impeded and the bin may selectively be locked in position. The organizer also includes a locking mechanism for selectively locking one or more bins in their fully closed position, wherein said locking mechanism is configured to reciprocally move between an unlocked position and a locked position. In the unlocked position, a bin may freely move between its open position and its fully closed position. In the locked position, a bin in its fully closed position is locked in place, and a bin in its open position or its first closed position, is freely movable between said positions. Also, when the locking mechanism is in the locked position, a bin in its first closed position may be moved to the fully closed position at which point it will become locked in place.

BRIEF DESCRIPTION OF THE DRAWINGS

Embodiments of the invention will now be described by way of example with reference to the drawings in which:

FIG. 5 (*b*) illustrates a cutaway perspective view of the locking mechanism;

FIG. 5 (*c*) illustrates a detailed view of the locking switch, locking arm and locking plate;

FIG. 5 (*d*) illustrates a cutaway view of the locking mechanism;

FIG. 7 (*b*) illustrates a front view of the locking arm;

FIG. 8 (*b*) illustrates an exploded view of an alternate embodiment of a bin.

DETAILED DESCRIPTION OF THE INVENTION

Figure 1:
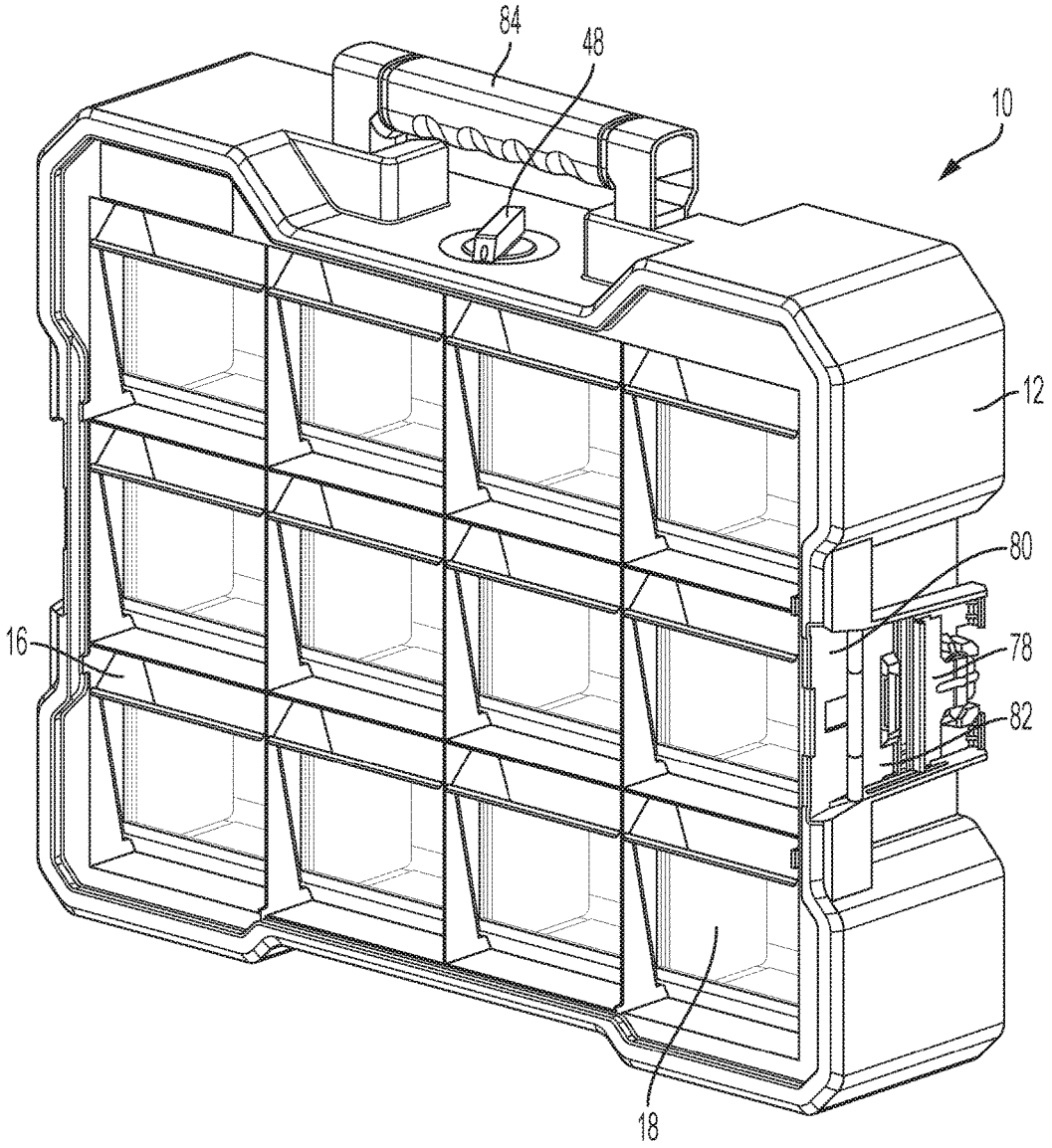
FIG. 1 illustrates a perspective view of an organizer according to the invention with all of its bins closed.
Figure 2:
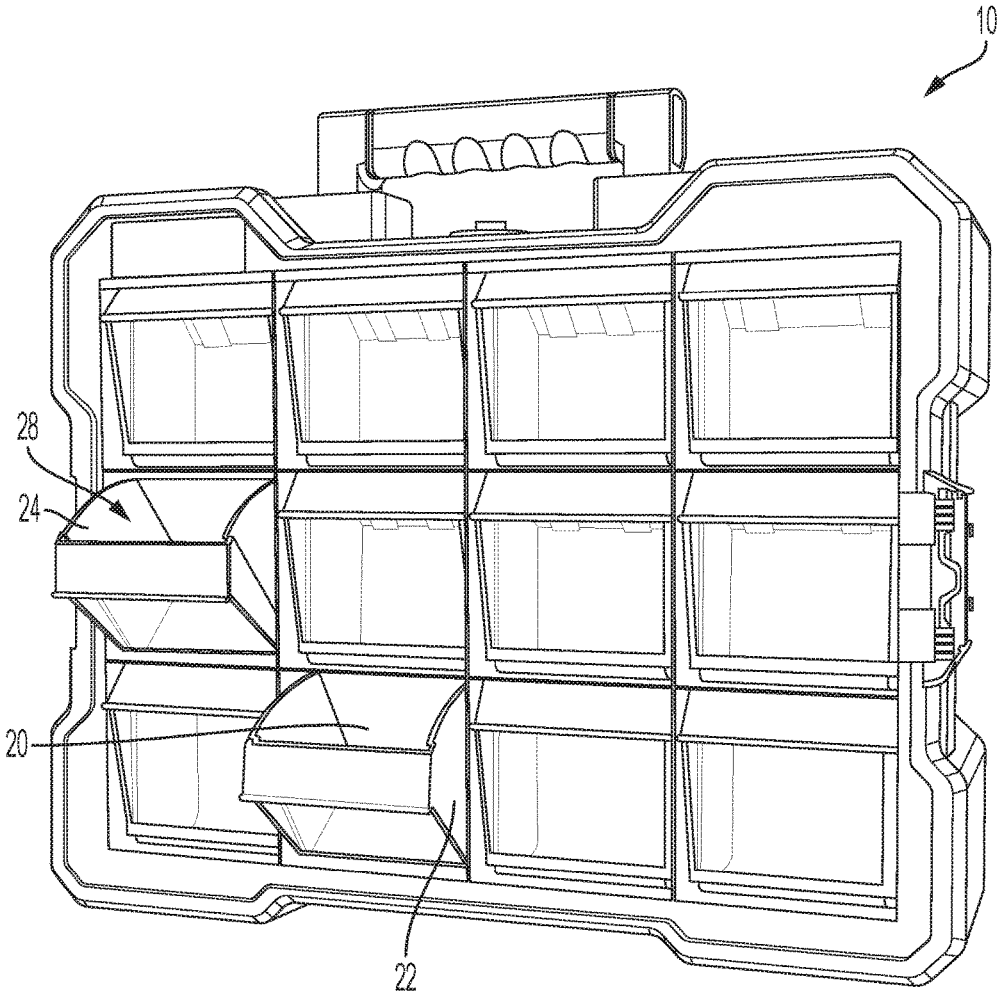
FIG. 2 illustrates a perspective view of the organizer with some of its bins in their open position.
Figure 3:
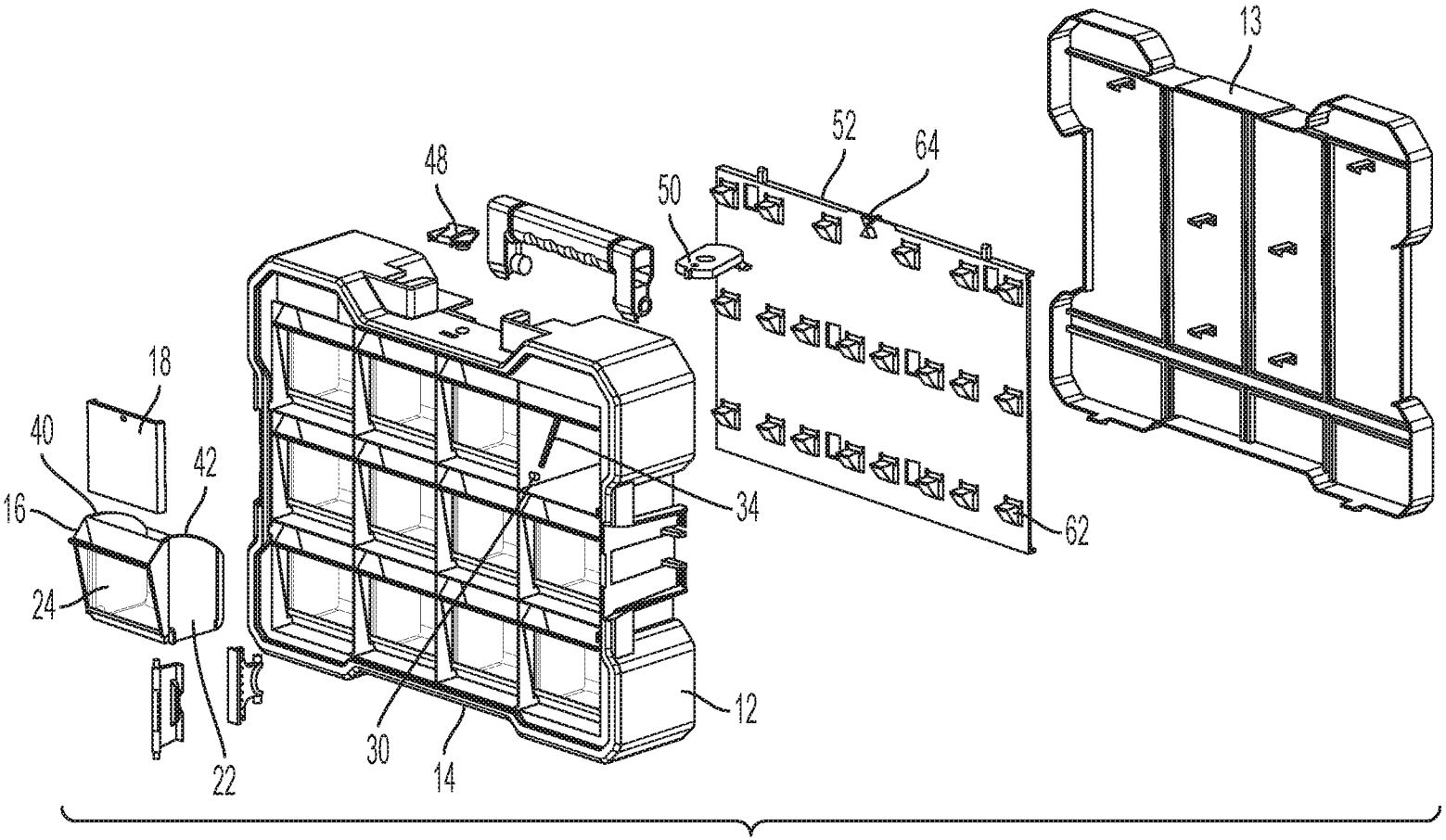
FIG. 3 illustrates an exploded view of the organizer.
Figure 4:
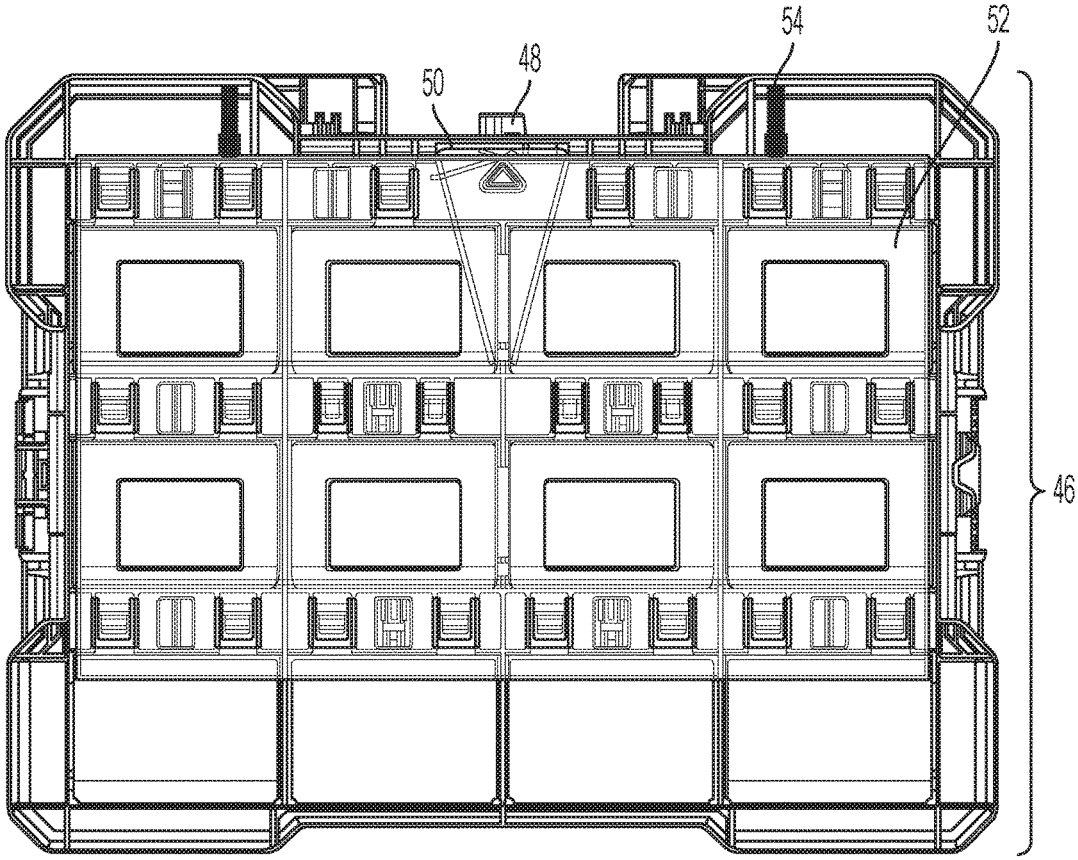
FIG. 4 illustrates a cutaway view of the back of the organizer showing the locking mechanism.
Figure 5A:
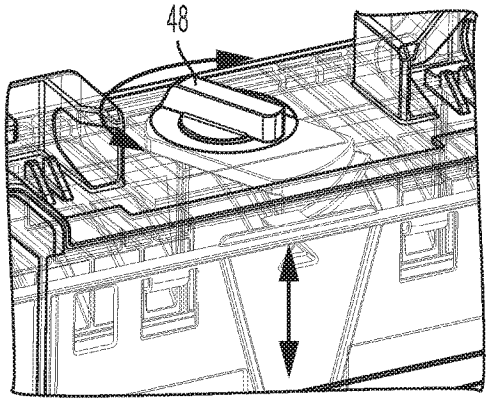
FIG. 5 (*a*) illustrates a detailed view of the movement of the locking switch and locking arm.
Figure 5B:
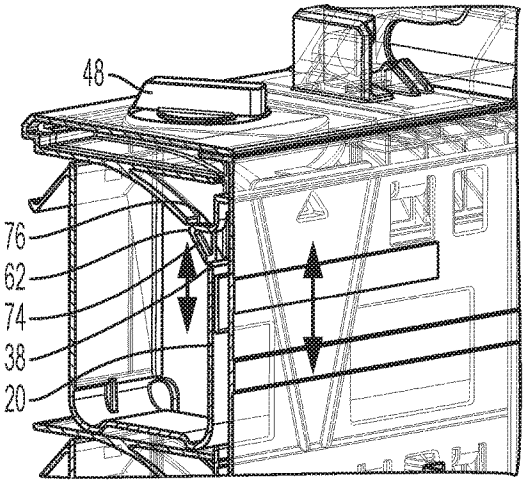
Figure 5C:
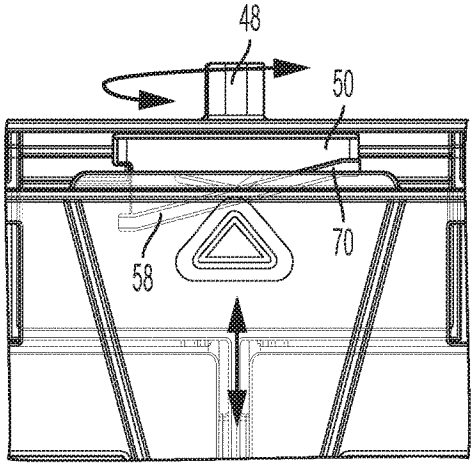
Figure 5D:
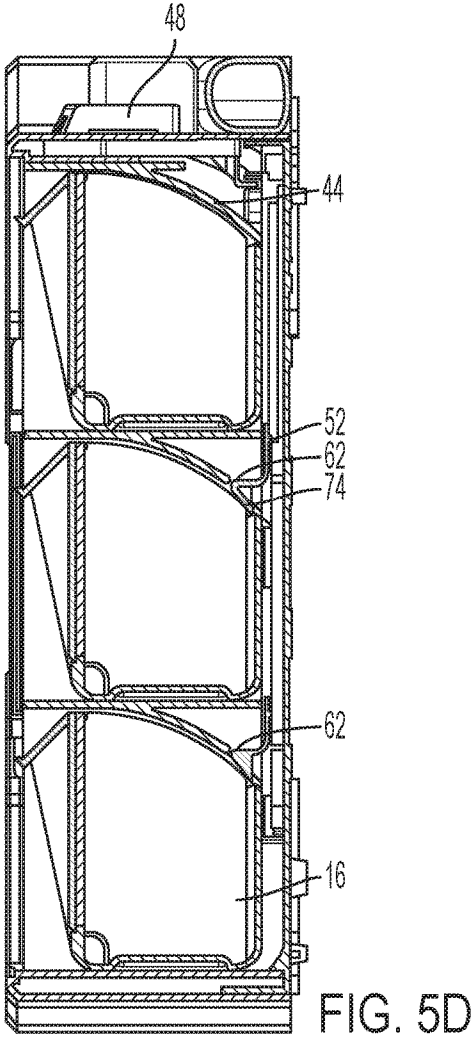
Figure 8B:
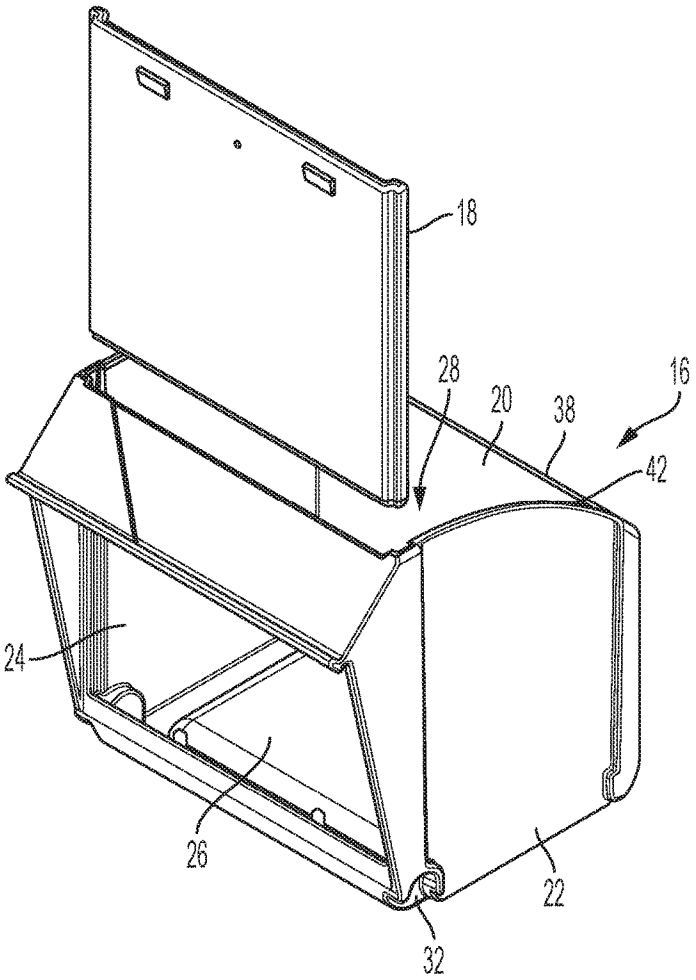
FIG. 8 (*a*) illustrates an oblique view of a bin.
Figure 8A:
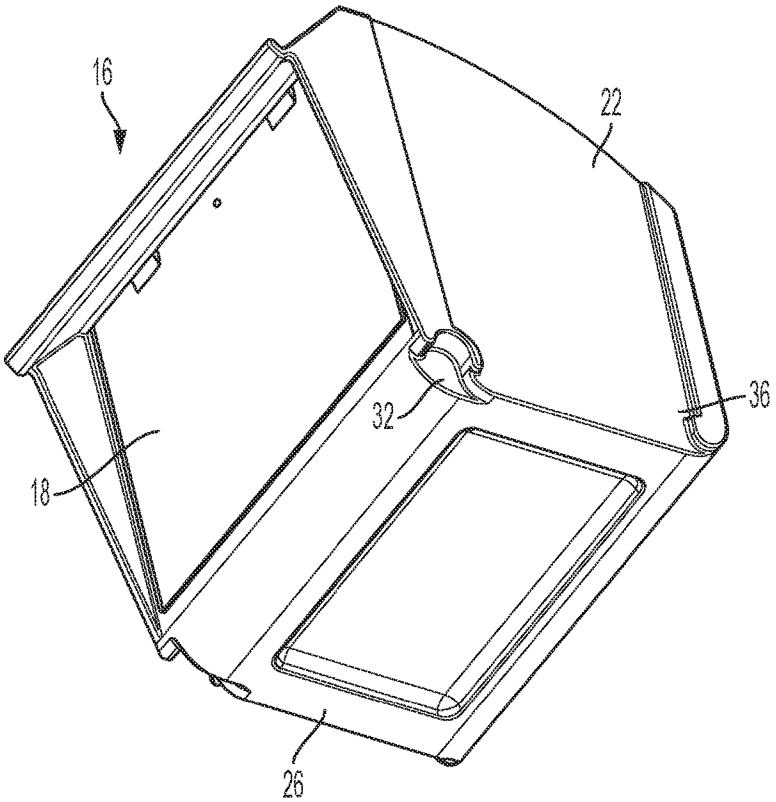

As shown in FIGS. 1, 2, and 3, an embodiment of an organizer 10 includes a housing 12 having one or more compartments 14. Housing 12 may be a single enclosure or it may include a removable back portion 13. Each compartment 14 is configured to receive a bin 16. Bin 16 includes a front panel 18, a back panel 20, a left side panel 22, a right side panel 24, and a bottom panel 26. The panels of bin 16 define an interior space 28 that may be suitable for holding a variety of small accessories such as nuts, bolts, screws, and washers (not shown). The front panel 18 of bin 16 may be transparent to allow for visual access to the interior space 28. In an alternate embodiment, as shown in FIGS. 3 and 8(*b*), the front panel 18 may also be removable from the bin 16.

As is shown in FIG. 2, each bin 16 is configured to move within its compartment 14 between an open position and a fully closed position. In the open position, access to the interior space 28 is unimpeded. In the fully closed position, access to the interior space 28 is impeded and, as will be discussed below, the bin 16 may be selectively locked in this fully closed position. To accomplish the movement between the open position and the fully closed position, it is preferable for the bin 16 to be pivotally attached within its compartment 14. Each compartment may include a bin engagement protrusion 30. Similarly, each bin 16 may include a bin engagement protrusion receiving portion 32. In a preferred embodiment, the bin engagement protrusions 30 engage the bin engagement protrusion receiving portions 32 and allow the bin to pivot within the compartment 14 between an open and fully closed position. Those skilled in the art will recognize that when the bin is pivoted into its open position, the bin engagement protrusions 30 may be selectively disengaged from their respective bin engagement receiving portions thus allowing the entire bin 16 to be removed from the compartment 14 and housing 12.

In addition to the bin engagement protrusions 30, each compartment 14 may further include a bin stop protrusion 34. The bin stop protrusion 34, which may preferably have an angled orientation, is configured to engage a bin stop engagement portions 36. As show in FIG. 8(*a*), the bin stop engagement portion 36 may be a small hook shaped protrusion on the exterior of either the left side panel 22 or right side panel 24 of the bin 16.

The pivotal movement of bin 16 within compartment 14 is such that an upper edge 38 of the back panel 20 moves along an arcuate path as the bin moves from its fully closed position to its open position. Similarly, the respective upper edges 40, 42 of the right side panel 24 and left side panel 22 are also preferably arcuate. As shown in the cutaway view of FIG. 5(*c*), each compartment 14 may also contain an arcuate roof 44. The arcuate nature of roof 44 is configured to closely match the arcuate upper edges 40, 42. Similarly, the arc of roof 44 closely matches the arc that upper edge 38 travels as the bin 16 pivots from its fully closed position to it open position.

Organizer 10 also includes a selectively operable locking mechanism 46. Locking mechanism 46 comprises a locking switch 48, a locking arm 50, a locking plate 52, and at least one spring 54. The components of locking mechanism 46 are configured to move between a unlocked position and a locked position. In the unlocked position, each bin 16 of the organizer 10 is freely movable between its open position and its fully closed position. When the locking mechanism 46 is in its closed position, each bin 16 that is in its fully closed position becomes securely locked in place. However, bins 16 that are in the open position may freely move between said open position and a first closed position. In this first closed position, which is in between the open position and fully closed position, access to the interior portion 28 is impeded but the bin 16 is not lockable. If the locking mechanism 46 is in its locked position and bin 16 is in the first closed position, if so desired, the bin 16 may be moved into its fully closed position where it will become locked in place. As will be shown below, locking mechanism 46 can accomplish this without unlocking any other bins 16 that are already locked in their fully closed position.

The locking switch 48 of locking mechanism 46 is accessible from the exterior of the housing 12. Locking switch 48 is configured to move between a first position and a second position, wherein the first position coincides with the unlocked position of locking mechanism 46 and the second position coincides with the unlocked position of the locking mechanism 46. As shown in FIGS. 5 (*a*)-(*d*), the locking switch 48 may be handle. Those skilled in the art will recognize that locking switch 48 could also be a slide or lever.

Locking switch 48 is connected to locking arm 50. Locking arm 50 may be disposed within the housing 12 and may not be generally accessible except through the locking switch 48. As shown in FIG. 3, the locking switch 48 and locking arm 50 may be separate parts. However, those skilled in the art will recognize that the locking switch 48 and locking arm 50 may be formed such that they are integral to one another. Locking arm may generally comprise a horizontal portion 56 and a ramp portion 58. An outer edge 60 of the ramp portion 58 may be configured to engage the locking plate 52.

Figure 6:
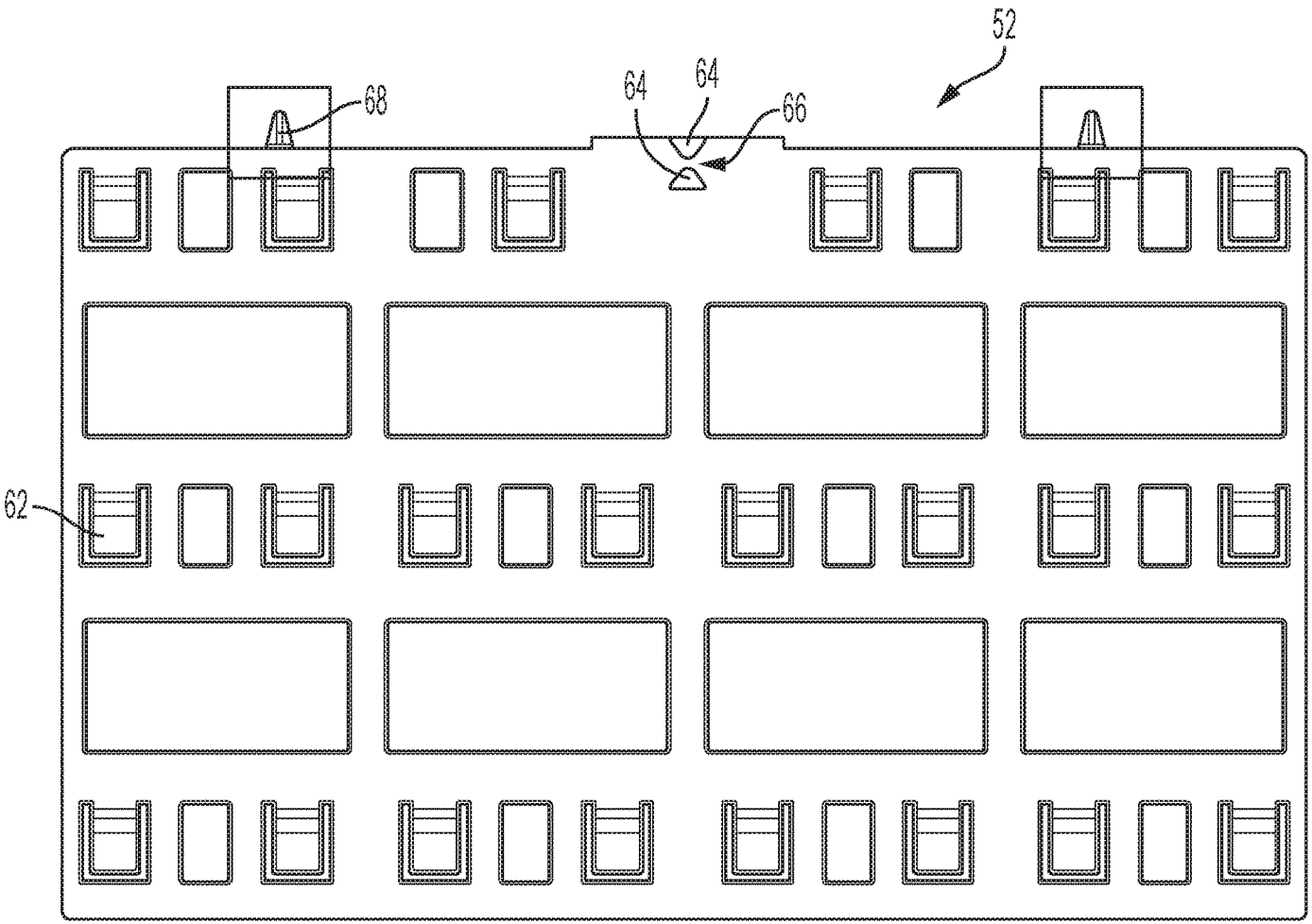
FIG. 6 illustrates a plan view of the locking plate.
Figure 7A:
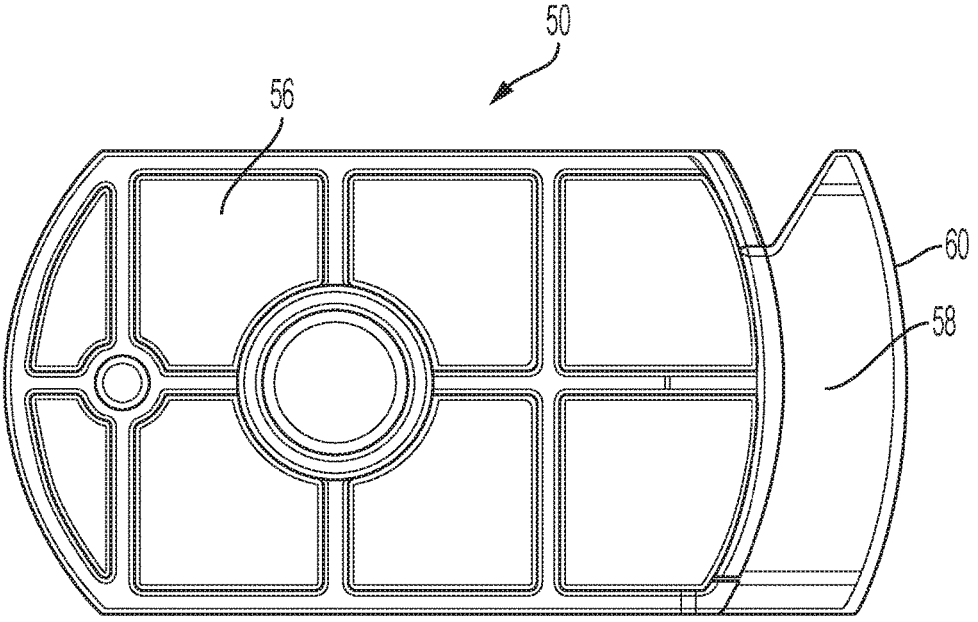
FIG. 7 (*a*) illustrates a plan view of the locking arm.
Figure 7B:
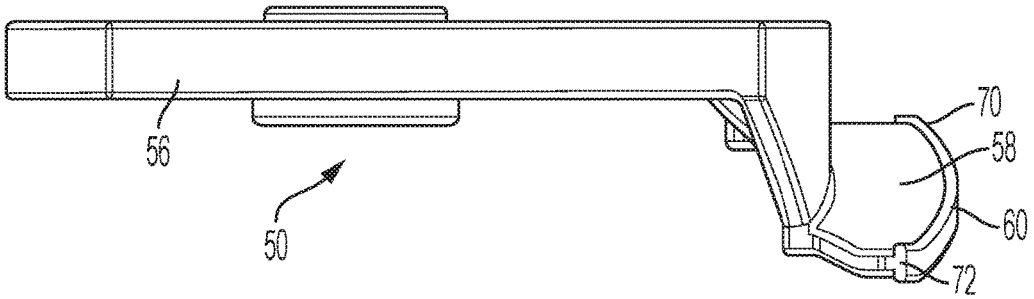

Like the locking switch 48, locking plate 52 is configured to move between a first position and a second position, wherein the first position coincides with the unlocked position of the locking mechanism 46 and the second position coincides with the locked position of the locking mechanism 46. As shown in FIGS. 3 and 6, locking plate 52 may include a plurality of bin engaging protrusions 62. The locking plate 52 may also include two locking arm protrusions 64. Locking arm protrusions 64 define a space 66 there between. Space 66 is configured to receive the outer edge 60 of the ramp portion 58 of locking arm 50.

The locking mechanism 46 may also include one or more springs 54. Spring 54 may be disposed between the housing 12 and the locking plate 52. Locking plate 52 may also include one or more spring receiving portions 68. Spring 54 may bias the locking plate 52 toward its second position.

Those skilled in the art will recognize that the organizer 10 of the present application may also include a back-to-back latch 78 that is configured to engage a latch engaging region 80 on another organizer. When engaged, the back-to-back latch permits two organizers to be secured to one another such that the bins 16 from both organizers are accessible simultaneously. Similarly, organizer 10 may also include one or more stacking latches 82. Stacking latches 82 may be configured to engage latch engaging regions 80 on adjacent containers or items such that the organizer 10 can be in stacking engagement therewith. Finally, those skilled in the art will recognize that a handle 84 may be included to allow for easy transportation of the organizer 10.

It may be appreciated that any of the components discussed in the organizer of the present application may be formed from any appropriate material in various embodiments, including metals, plastics, and combinations thereof. Additionally, in some embodiments components described above may be assemblies of subcomponents. Additionally, various components may be formed integral to one another. Assemblies of components together may be by any appropriate mechanism, including but not limited to adhesion, welds, snap fit, and fastening with fasteners (including but not limited to bolts, screws, rivets, etc.). Other modifications to the disclosure herein provided may be understood as being within the scope of claims enabled by this disclosure.

INDUSTRIAL APPLICABILITY

In operation, as discussed above, the locking mechanism 46 is configured to move between an unlocked and a locked position. In the unlocked position, the locking switch 48 may be in its first position. In this first position of the locking switch 48, the locking arm 50, which is connected to the locking arm 48, is positioned such that the outer edge 60 of ramp portion 58 is engaged to the locking plate 52 at a high end 70 of the ramp portion 58. When the outer edge 60 of the ramp portion 58 engages the space 66 defined by the locking arm protrusions 64 at the high end 70, the entirety of the locking plate 52 is moved against the bias of spring 54 and toward its first position. In this first position, each bin engaging protrusion 62 is lifted out of contact with the back panel 20 of bin 16. Thus, bin 16 is freely movable between its fully closed position and its open position.

Conversely, when the locking mechanism is in its locked position, the locking switch 48 is toggled to its second position. In this position, the locking arm 50, which is connected to the locking switch 48, is oriented such that a low end 72 of the ramp portion 58 is engaged to the locking plate 52. When the outer edge 60 of ramp portion 58 engages the space 66 defined by the locking arm protrusions 64 at the low end 72, the entirety of the locking plate 52 is moved toward its second position. In this second position, each bin engaging protrusion 62 is moved downward such that it is in locking engagement with the back panel 20 of any bin 16 that is in the fully closed position.

When the locking mechanism 46 is in its locked position, a bin 16 may be its open position. If this occurs, bin 16 will be free to move between the open position and the first closed position, wherein the back panel 20 may be in contact with the bin engaging protrusion 62 of the locking plate 52, but not in locking engagement therewith. Instead, the back panel may merely lean against a tapered face 74 of the bin engaging protrusion 62. Bin engaging protrusion 62 may also include a flexible arm 76. The tapered face 74 and flexible arm 76 of the bin engaging protrusion allow for a bin 16 to move from the first closed position to the fully closed position, without unlocking any other bins from their fully closed position. This may be accomplished by applying pressure to the bin 16 such that the upper edge 38 of the back panel 20, slides along the tapered face 74. As bin 16 is moved closer toward the fully closed position, flexible arm 76 may flex a bit to move the entirety of bin engaging protrusion 62 out of position a bit to allow the bin 16 to settle into its fully closed position. When this occurs, the flexible arm 76 will move the bin engaging protrusion back into its original position, wherein it locks the bin 16 securely in its fully closed position. Thus, a bin 16 is able to move between its first closed position and its fully closed position without unlocking any other bins that may already be secured in their fully closed position.

We claim:

1. An organizer comprising:

A housing including one or more compartments for receiving a bin;

A first bin disposed in a compartment and comprising a front panel, a back panel, a right side panel, a left side panel, and a bottom panel all of which define an interior portion, wherein said first bin is pivotally attached within the compartment, and is configured to reciprocally move between an open position, a first closed position and a fully closed position, wherein the first closed position is between the open position and the fully closed position, and wherein in the open position, access to the interior portion is unimpeded, and in the first closed position, access to the interior portion is impeded, but the bin is not lockable, and in the fully closed position access to the interior portion is impeded and the bin may selectively be locked in position; and A locking mechanism for selectively locking one or more bins in their fully closed position, wherein said locking mechanism is configured to reciprocally move between an unlocked position and a locked position, wherein in the unlocked position, a bin may freely move between its open position and its fully closed position; and wherein in the locked position, a bin in its fully closed position is locked in place, and a bin in its open position or its first closed position, is freely movable between said positions, and wherein a bin in its first closed position may be moved to the fully closed position at which point it will become locked in place.

2. The organizer of claim 1, further comprising a second bin disposed in a compartment of the housing, and comprising a front panel, a back panel, a right side panel, a left side panel and a bottom all of which define an interior portion, wherein said second bin is pivotally attached within the compartment, and is configured to reciprocally move between an open position, a first closed position and a fully closed position, wherein the first closed position is between the open position and the fully closed position, and wherein in the open position, access to the interior portion is unimpeded, and in the first closed position, access to the interior portion is impeded, but the bin is not lockable, and in the fully closed position access to the interior portion is impeded and the bin may selectively be locked in position.

3. The organizer of claim 2, wherein the locking mechanism, when in the locked position is further configured to lock the first bin in the fully closed position and allow the second bin to move from the first closed position to the fully closed position, wherein the second bin will become locked in the fully closed position, without unlocking the first bin from its fully closed position.

4. The organizer of claim 3, wherein the locking mechanism comprises:

A locking switch accessible from the exterior of the housing and reciprocally movable between a first position and a second position, wherein the first position corresponds to the unlocked position of the locking mechanism and the second corresponds to the locked position of the locking mechanism;

A locking arm connected to the locking switch;

A locking plate comprising a plurality of bin engaging protrusions and engaged to the locking arm, and reciprocally movable between a first position and a second position, wherein the first position corresponds to the unlocked position of the locking mechanism and the second position corresponds to the locked position of the locking mechanism; and A biasing spring configured to bias the locking plate toward its second position.

5. The organizer of claim 4, wherein the locking plate further includes locking arm protrusions that define a space there between; and wherein the locking arm further includes a ramp shaped portion, the edge of which is disposed in the space defined by the locking arm protrusions of the locking plate and is configured to be in sliding engagement therewith; and Wherein, when the locking switch is in its first position, the ramp shaped protrusion of the locking arm holds the locking plate in its first position; and when the locking switch is in its second position, the ramp shaped protrusion holds the locking plate in its second position.

6. The organizer of claim 4, wherein the bin engaging protrusions of the lock plate include a flexible arm and at least one tapered face.

7. The organizer of claim 6, wherein the lock switch and lock arm are integrated.

8. The organizer of claim 7, wherein each compartment of the housing further includes an arc shaped roof that is configured to cover the interior portion of a bin disposed within the compartment.

9. The organizer of claim 8, further comprising a handle engaged to the housing and configured to allow the entire organizer to be carried therefrom.

10. The organizer of claim 9, further comprises a back-to-back latch and a latch engaging region.

11. The organizer of claim 10, further comprises a stacking latch.

12. The organizer of claim 1, wherein the first bin includes a selectively removable front panel.

13. The organizer of claim 12, wherein the first bin includes a transparent front panel.

14. The organizer of claim 1, wherein the first bin is selectively removable from the housing.

15. The organizer of claim 1, the compartment of the housing further includes at least one bin stop protrusion; and the first bin includes at least one bin stop engagement portion that is configured to engage the bin stop protrusion and allow the first bin to be held in its open position without falling out of the organizer.

16. The organizer of claim 1, wherein the compartment further includes at least one bin engagement protrusion; and the first bin includes at least one bin engagement protrusion receiving portion, configured to allow the bin to pivot there upon.

* * * * *